US005768337A

United States Patent [19]

Anderson

[11] Patent Number: 5,768,337

[45] Date of Patent: Jun. 16, 1998

[54] PHOTOELECTRIC X-RAY TUBE WITH GAIN

[75] Inventor: Weston A. Anderson, Palo Alto, Calif.

[73] Assignee: Varian Associates, Inc., Palo Alto, Calif.

[21] Appl. No.: 688,468

[22] Filed: Jul. 30, 1996

[51] Int. Cl.[6] ..... H01J 35/14; H01J 35/06

[52] U.S. Cl. ..... 378/136; 378/138

[58] Field of Search ..... 378/134, 136, 378/138, 140

[56] References Cited

U.S. PATENT DOCUMENTS

| | | | |
|---|---|---|---|
| 4,821,305 | 4/1989 | Anderson | 378/136 |
| 5,386,445 | 1/1995 | Rand | 378/10 |
| 5,504,796 | 4/1996 | De Silveira et al. | 378/121 |
| 5,576,549 | 11/1996 | Hell et al. | 250/423 |

*Primary Examiner*—David P. Porta
*Assistant Examiner*—David Vernon Bruce
*Attorney, Agent, or Firm*—Keiichi Nishimura; Bella Fishman

[57] ABSTRACT

An X-ray tube has an anode and a photocathode inside a vacuum envelope and an electron multiplier is disposed between them. Such an electron multiplier may be a plurality of sequentially disposed dynodes or a microchannel plate. Because of the secondary electron emission from such an electron multiplier, a higher-power radiation is obtained without requiring a high optical power level to generate photoelectrons. The vacuum envelope may be of a rotary type with the anode and photocathode having annular regions.

17 Claims, 2 Drawing Sheets

PHOTOELECTRIC X-RAY TUBE WITH GAIN

BACKGROUND OF THE INVENTION

This invention relates to photoelectric tubes for generating high-power X-rays.

With conventional X-ray tubes having a thermionic cathode and a fixed anode positioned at its opposite ends, the power capacity is limited by the conductive cooling of the anode target bombarded by an electron beam, which must be tightly focused if a high-definition image is required, as in medical radiography. U.S. Pat. No. 4,821,305, issued Apr. 11, 1989 and assigned to the Assignee of the present invention (herein incorporated by reference), for example, disclosed an X-ray tube comprising a vacuum envelope which is rotatable around an axis and an anode which is made a part of the envelope so as to rotate therewith. The rotating anode spreads the heat over an annular area of the target and provides much higher power for a short operating time. The cathode also rotates around the same axis, providing an axially symmetric band of photocathode surface illuminated by a focused stationary spot of light entering the envelope through an axially symmetric transparent window part of the vacuum envelope.

SUMMARY OF THE INVENTION

It is object of the invention a purpose of this invention to provide a further improved X-ray tube capable of generating a higher-power radiation with a high duty or CW operation, as desired for medical radiology or X-ray photolithography.

It is another object of the present invention to provide such an X-ray tube which does not require a high optical power level to generate photoelectrons.

It is still another object of the present invention to provide such an X-ray tube which permits the use of low-efficiency photocathode surfaces that are not very sensitive to ambient gas pressures as may be caused by outgassing of the anode or to relatively poor vacuum conditions.

An X-ray tube embodying this invention, with which the above and other objects and advantages can be achieved, may be characterized as having an electron multiplier between the photocathode and the anode of a prior art X-ray tube, the word "between" being used from the point of view of the travel paths of the photoelectrons emitted from the photocathode and bombarding the anode surface. The electron multiplier may comprise a number of dynodes disposed sequentially between the photocathode and the anode.

The vacuum envelope for supporting the anode, the photocathode and the electron multiplier therein may be spatially fixed and remain stationary or may be an axially symmetric rotor adapted to rotate around its axis of symmetry. With such an electron multiplier inserted between the photocathode and the anode, optical power of a much lower level may be used to generate photoelectrons. This will permit the use of a simpler optical system and result in lower cost. Another advantage is that low-efficiency photocathode surfaces may be used in the tube.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DESCRIPTION OF THE PREFERRED EMBODIMENTS

Figure 1:
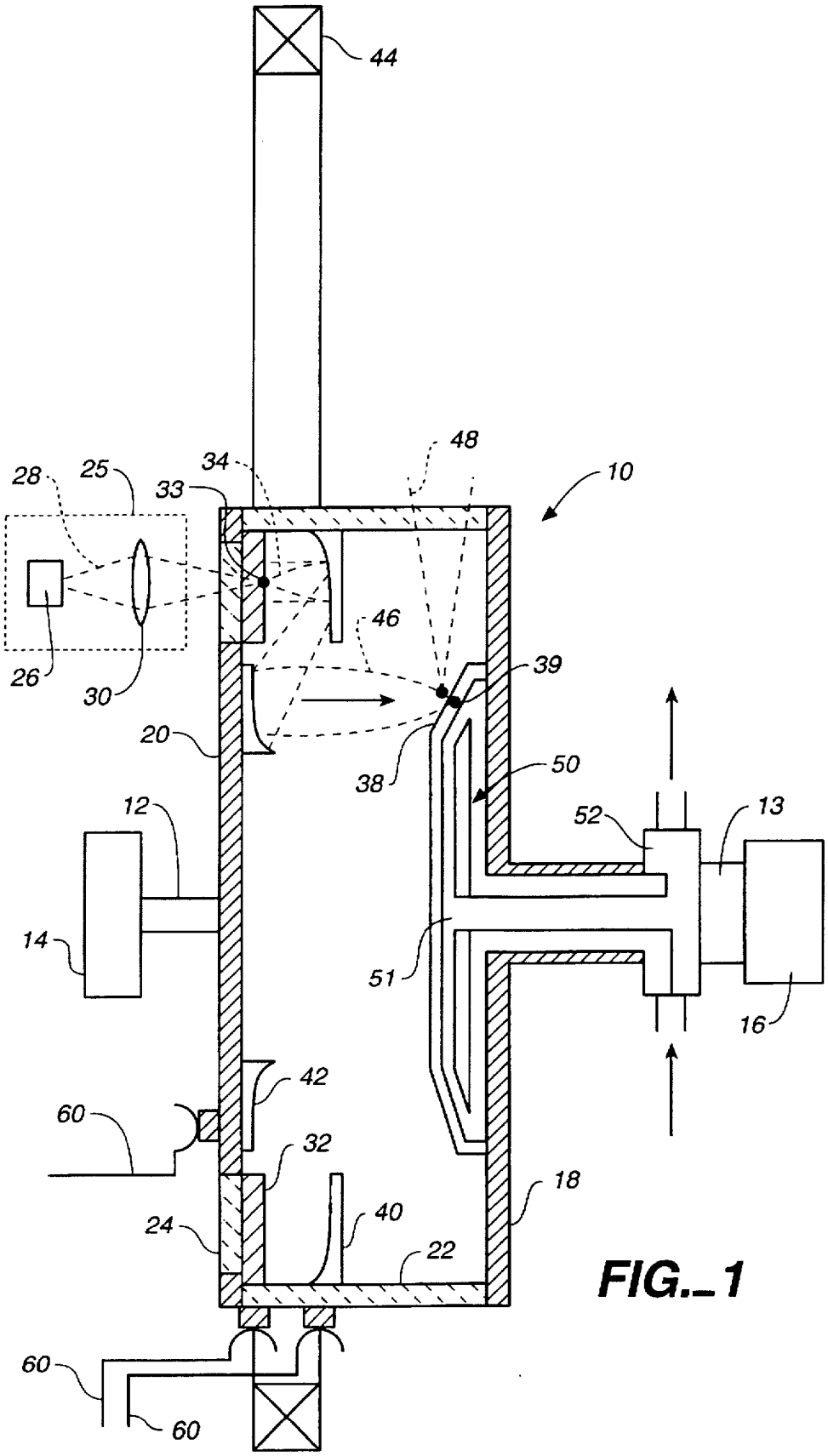
FIG. 1 is a schematic sectional view of an embodiment of the invention.

FIG. 1 shows an X-ray tube embodying the invention. An axially symmetric rotor 10 serves as a vacuum envelope and comprises two end plates (a front-end plate 20 and a back-end plate 18) joined by a hollow cylindrical element 22. The rotor 10 is connected to axially extending shafts 12, 13 on mutually opposite sides thereof, serving as high-voltage connections to the tube. The shafts 12, 13 are rotatable on one or more bearings 14 and are driven by a motor 16. An annular section (referred to as the window 24) of the front-end plate 20, radially distal from the axis of symmetry, is of an optically transparent material such as glass or sapphire, hermetically sealed to adjacent metal parts. An annular photocathode 32 is held on the vacuum inner side of the window 24 so as to rotate in its own plane when the rotor 10 is rotated around its axis of symmetry. A stationary external light source unit 25 of a conventional kind, having a light source 26 and a stationary converging lens 30, is disposed such that a beam of electromagnetic radiation 28, such as visible or ultraviolet light, emitted from the light source 26 will be focused by the stationary converging lens 30 at a spatially stationary electron-emitting region 33, which is occupied by the photocathode 32 and through which the rotating photocathode 32 will pass as it rotates. Photoelectrons 34, emitted at the aforementioned stationary electron-emitting region 33, are generally drawn off by the positive voltage on a dynode 40 attached to the cylindrical element 22.

Two annular dynodes (first dynode 40 and second dynode 42), each having an electron-multiplying surface and serving as an electron-multiplier, are attached to and hence adapted to rotate with the rotor 10 and the photocathode 32. The first dynode 40 is disposed so as to have its electron-multiplying surface in a face-to-face relationship with the photocathode 32. The second dynode 42 is attached to the front-end plate 20 of the rotor 10 and, having a smaller diameter, is concentric to and inside the annular photocathode 32.

According to the embodiment shown in FIG. 1, the voltages required to operate the electron multiplier system are introduced from outside through slip rings and brushes 60 connected individually to the photocathode 32 and the dynodes 40, 42 though the cylindrical element 22 or the front-end plate 20 of the rotor 10. The dynodes 40, 42 are so disposed and their electron-multiplying surfaces are so configured that photoelectrons 34, emitted at the aforementioned stationary electron-emitting region 33, will cause secondary electrons to be emitted from the first dynode 40 and directed to the electron-multiplying surface of the second dynode 42. Secondary electrons 46, thereby emitted from the second dynode 42, are accelerated towards an anode 38 by a high positive voltage applied on the anode 38 and may be focused by a stationary, generally axial magnetic field (indicated by an arrow), which may be generated by an external coil 44, onto a spatially stationary X-ray generating region 39, which is occupied by the anode 38 and through which the anode 38 passes as it rotates with the rotor 10. The portion of the surface of the anode 38 which passes this X-ray generating region 39 is so configured that X-rays 48 emitted therefrom propagate out through the cylindrical element 22 of the rotor 10. Thus, this cylindrical element 22 of the rotor 10 should not only be a high-voltage insulator effective against the large voltage difference between the two end plates 18, 20 but also have high X-ray transmissivity, such as high-alumina ceramic. Heat from the anode 38 is carried off by a liquid cooling system 50 including a rotary part 51 and a stationary connector 52 which are rotatably coupled to each other. The rotary part 51 of the cooling system 50 is adapted to rotate with the rotor 10 (and the anode 38) and to circulate a liquid coolant in the space between the anode 38 and the back-end plate 18. The connector 52 has a coolant inlet and a coolant outlet (indicated by arrows) and is connected to an external coolant circulating system (not shown).

The description of the invention, given above with reference to FIG. 1, is not intended to limit the scope of the invention. Many modifications and variations are possible within the scope of the invention. For example, the electrons which bombard the anode need not be focused by a stationary, generally axial magnetic field, as described above with reference to FIG. 1. Alternatively, electrostatic or proximity focusing may be used. The voltages required to operate the electron multiplier system need not necessarily be brought to the rotating electron multiplier through slip rings and brushes. Use may alternatively be made of an internal voltage divider driven by the anode voltage source. Although an embodiment with two dynodes was shown in FIG. 1, neither is this intended to limit the scope of the invention. Generally, a plurality of dynodes may be disposed sequentially between the cathode and the anode (along the electron path), each dynode typically having a potential of several hundred to several thousand volts higher than the previous dynode. The current gain at each dynode depends upon the dynode material and the energy of the incoming electron. (See Seiler, J. Appl. Phys. Vol. 54, No. 11, pp. R1–R18, November, 1983 for examples.) In most of these systems, care must be taken not to allow the total gain to be too large because a runaway condition may be developed otherwise. Such a condition may occur when an X-ray strikes the photocathode to release an electron that produces enough additional X-rays such that the photocathode may release additional photoelectrons with a high probability. Under such a condition, the electron current will increase exponentially until a saturation value is reached. Since the probability of producing an X-ray is typically $10^{-4}$ or less, one can safely use gains in the range of $10^3$ to $10^4$.

Figure 2:
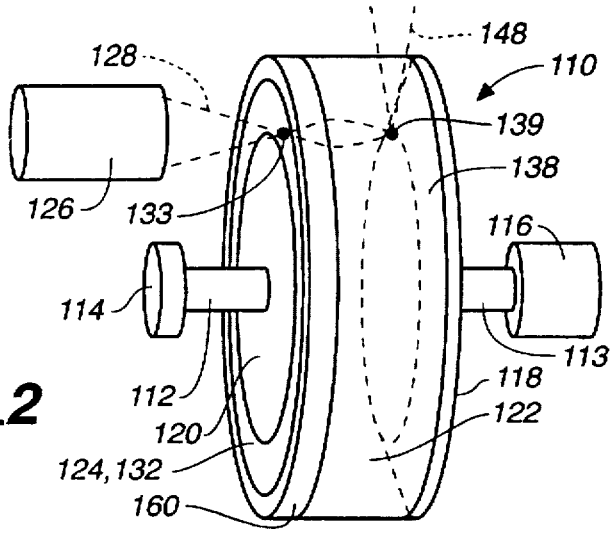
FIG. 2 is an isometric sketch of another embodiment of the invention.

Rather than using dynodes, one can use a microchannel plate or a distributed gain system similar in principle to a channeltron electron multiplier. FIG. 2 shows another X-ray tube embodying the invention, characterized as using a microchannel plate 160, instead of dynodes, as an electron multiplier. Since the X-ray tube of FIG. 2 is very much like the one shown in FIG. 1 in all other aspects, its components which are substantially similar to those described above with reference to FIG. 1 are either omitted or indicated by numerals with the same last two digits as those used in FIG. 1 to indicate the corresponding components.

With reference now to FIG. 2, the vacuum environment for this X-ray tube is provided by an axially symmetric rotor 110 comprising a front-end plate 120 and a back-end plate 118 joined by a hollow cylindrical element 122 and being supported by two shafts 112, 113 rotatably through one or more bearings 114, a motor 116 being provided to rotate the rotor 110 around the axis of its symmetry. The front-end plate 120 has an annular window 124 of an optically transparent material such as glass, and an annular photocathode 132 is held on the vacuum inner side of the window 124 so as to rotate with the rotor 110. The microchannel plate 160 is also annular, disposed in a face-to-face relationship with the photocathode 132. An annular anode 138 with a liquid cooling system (not visible in FIG. 2) behind (that is, towards the motor 116 with reference to FIG. 2) is attached to the back-end plate 118 so as to rotate with the rotor 110. A beam of electromagnetic radiation 128 such as light emitted from a stationary external light source system 125 is focused at a spatially stationary electron-emitting region 133, which is occupied by the photocathode 132 and through which the rotating photocathode 132 will pass. Photoelectrons produced by the photocathode 132 are received by the microchannel plate 160, causing secondary emission. The electrons thus multiplied are drawn towards the anode 138 by a high positive voltage applied thereon and focused by a stationary, generally axial magnetic field (not shown) onto a spatially stationary X-ray generating region 139, which is occupied by the anode 132 and through which the annular anode 138 will pass as it rotates. The anode surface is so configured that X-rays 148 emitted from the X-ray generating region 139 will propagate out through the cylindrical element 122 made of a material with high X-ray transmissivity.

Figure 3:
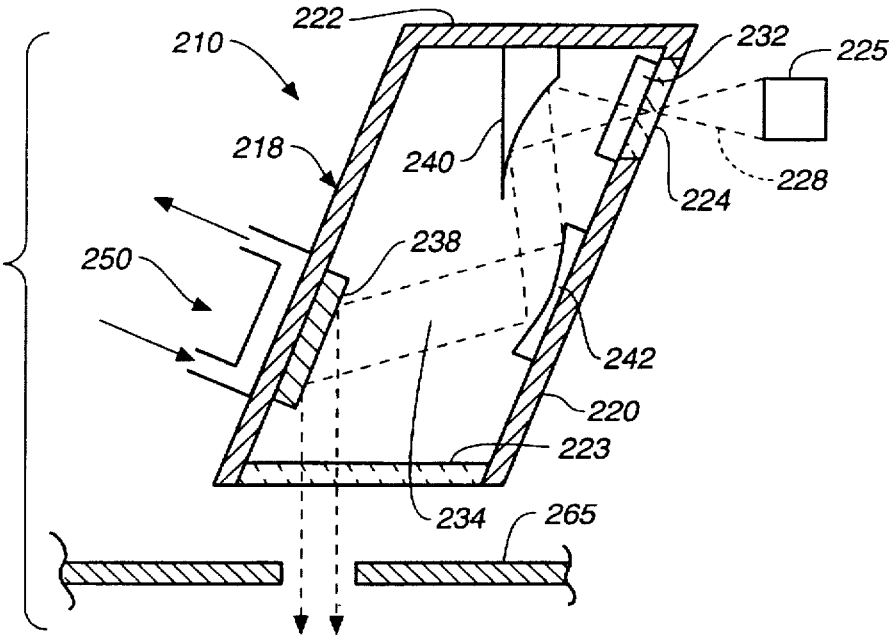
FIG. 3 is a schematic sectional view of a third embodiment of the invention.

The present invention relates also to X-ray tubes with a non-rotary anode. FIG. 3 shows still another X-ray tube embodying this invention, characterized as having a pair of dynodes (a first dynode 240 and a second dynode 242) disposed as electron multipliers between a photocathode 232 and an anode 238. The vacuum envelope according to this embodiment is constituted by a stationary sealed container tube 210 with a front-end plate 220 and a back-end plate 218 joined by a top member 222 and an optically transparent bottom plate 223. Side walls to form a sealed enclosure are not shown. Although not apparent from FIG. 3, this container tube 210 may be axially elongated in the direction perpendicular to the page. The total length may be many feet, which makes this embodiment particularly useful, for example, in a land mine detector system.

A portion of the front-end plate 220 is of an optically transparent material and serves as a sealed window 224, and a planar photocathode 232 is held stationary, affixed to the container tube 210 on the vacuum inner side of the window 224. An external light source unit (shown schematically at 225) is disposed outside and opposite the window 224. The light source 225 may include a scanning device for causing light 228 emitted therefrom to pass through different parts of the window 224 and to be focused sequentially at different surface regions of the photocathode 232. The two dynodes 240, 242, each having an axially elongated electron-multiplying surface, are so attached respectively to the top member 222 and the front-end plate 220 and their electron-multiplying surfaces are so configured that secondary electrons 234 emitted from the second dynodes 242 are directed generally towards the planar anode 238 attached to the back-end plate 218, accelerated by a high positive voltage applied to the anode 238. The planar anode 238 is so oriented that the X-rays generated by the electrons 234 bombarding thereon will pass through the bottom plate 223 which is transparent to X-rays. Numeral 265 symbolically indicates a shield with an X-ray passing aperture or collimator. A liquid cooling system 250 with a coolant inlet and a coolant outlet, connected to an external coolant circulating system (not shown), is provided behind the anode 238.

Figure 4:
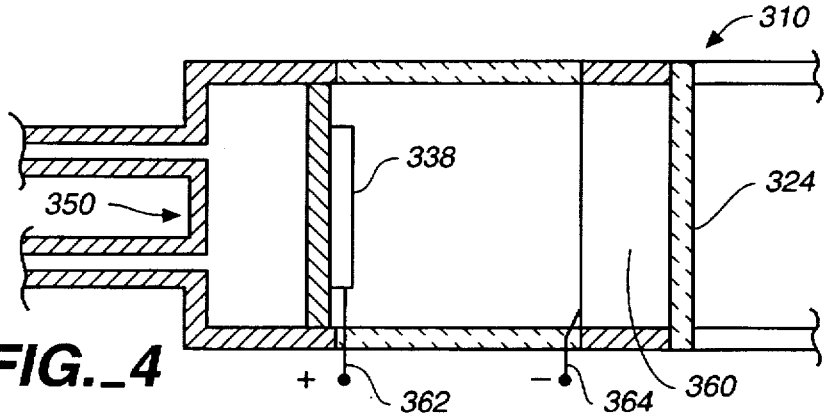
FIG. 4 is a schematic sectional view of a fourth embodiment of the invention.

FIG. 4 shows still another X-ray tube 310 embodying this invention with a non-rotary anode, characterized as having a microchannel plate 360 with a sufficiently high gain, serving as an electron multiplier. If the loop gain is sufficiently high, no external light source or thermal cathode of the type shown in FIGS. 1, 2 and 3 will be necessary because the electron current will soon reach a saturation level, as soon as the system is started by a first electron, and remain in that state as long as the high voltage is applied. Thus, FIG. 4 shows a stationary sealed container tube 310 with the microchannel plate 360 affixed thereto on the inner vacuum side of its front window 324. A planar anode 338 is attached to the tube 310 and disposed in a face-to-face relationship with the microchannel plate 360. Numerals 362 and 364 schematically indicate connectors connecting the anode 362 and the microchannel plate 360 respectively to a high positive voltage source and a high negative voltage source (not shown), such that the electrons from the microchannel plate 360 are accelerated towards the anode 338 and generate X-rays by bombarding its surface. Thus, the side walls of the tube 310 between the anode 338 and the microchannel plate 360 are of a material serving not only as a high-voltage insulator but also a transmitter of X-rays. A liquid cooling system 350 with a coolant inlet and a coolant outlet, connected to an external coolant circulating system (not shown), is provided behind the anode 338. Depending on the purpose of use, the tube 310 may be enclosed in a shielding container (not shown) with a collimating means, as shown in FIG. 3. With loop gains less than one, the electrons of X-ray tube of FIG. 4 may be derived from the photocathode irradiated by an external light source.

The invention was described above with reference to only a limited number of examples, but these examples are intended to be illustrative, not as limiting the scope of the invention. Many modifications and variations are possible within the scope of this invention. For example, instead of using transmission photocathodes, arrangements can be made to use photocathodes wherein light impinges on the same surface from which electrons are emitted. Different forms of cooling can also be used. As another example, metallic protuberances (say, in the shape of spiral fins) may be provided to the vacuum envelope for radiating heat therefrom, as illustrated in aforementioned U.S. Pat. No. 4,821,305, issued Apr. 11, 1989. It is to be understood that all such modifications and variations that may be apparent to a person skilled in the art are within the scope of this invention.

What is claimed is:

1. An X-ray generating device comprising:

a vacuum envelope;

an anode inside and affixed to said vacuum envelope, said anode having an X-ray generating surface capable of generating X-rays by bombardment of electrons thereon;

an electron multiplier inside and affixed to said vacuum envelope, said electron multiplier comprising a microchannel plate being capable of emitting a larger number of secondary electrons by bombardment of a smaller number of primary electrons thereon;

said vacuum envelope including an insulator between said anode and said electron multiplier; and cooling means for cooling said anode from outside said vacuum envelope.

2. The X-ray generating device of claim 1, wherein a substantial gain of said electron multiplier causes a continuous generation of X-rays while an anode voltage is applied to said anode.

3. An X-ray generating device comprising:

a vacuum envelope having an optically transparent window;

an anode inside and affixed to said vacuum envelope, said anode having an X-ray generating surface capable of generating X-rays by bombardment of electrons thereon;

a photocathode affixed to said vacuum envelope inside said window;

an electron multiplier affixed to said vacuum envelope between said anode and said photocathode, said electron multiplier being capable of emitting a larger number of secondary electrons by bombardment of a smaller number of primary electrons thereon;

cooling means for cooling said anode from outside said vacuum envelope; and optical means for focusing a beam of electromagnetic radiation from a source outside said vacuum envelope through said window;

said vacuum envelope including an insulator between said anode and said photocathode.

4. The X-ray generating device of claim 3 wherein said optical means is capable of focusing said beam successively at different regions of said photocathode.

5. The X-ray generating device of claim 3 wherein said optical means focuses said beam at a spatially stationary electron-emitting region occupied by said photocathode.

6. The X-ray generating device of claim 3 further comprising electron beam focusing means for focusing electrons emitted from said electron multiplier at a spatially stationary X-ray generating region occupied by said anode.

7. The X-ray generating device of claim 3 wherein said electron multiplier comprises a plurality of dynodes sequentially disposed between said photocathode and said anode.

8. The X-ray generating device of claim 7 further comprising means for applying sequentially increasing voltages to said plurality of dynodes.

9. The X-ray generating device of claim 3 wherein said electron multiplier comprises a microchannel plate.

10. The X-ray generating device of claim 3 wherein said vacuum envelope is cylindrically symmetric around an axis, said X-ray generating device further comprising rotating means for causing said vacuum envelope to rotate around said axis, said photocathode and said anode being annular around said axis.

11. The X-ray generating device of claim 10 wherein said optical means focuses said beam sequentially at a series of spatially stationary electron-emitting regions occupied by said photocathode.

12. The X-ray generating device of claim 10 wherein said window is annular and said photocathode is disposed on inner surface of said window.

13. The X-ray generating device of claim 12 wherein said source is stationary.

14. The X-ray generating device of claim 10 wherein said electron multiplier comprises a microchannel plate.

15. The X-ray generating device of claim 10 further comprising electron beam focusing means for focusing electrons emitted from said electron multiplier at a spatially stationary X-ray generating region occupied by said anode.

16. The X-ray generating device of claim 10 wherein said electron multiplier comprises a plurality of dynodes sequentially disposed between said photocathode and said anode.

17. The X-ray generating device of claim 16 further comprising means for applying sequentially increasing voltages to said plurality of dynodes.

* * * * *